US006332472B1

(12) United States Patent
Kuo

(10) Patent No.: US 6,332,472 B1
(45) Date of Patent: Dec. 25, 2001

(54) RETRACTING MECHANISM USED IN AN AUTOMATIC MULTIPLE COLLAPSIBLE UMBRELLA

(76) Inventor: Shih Shin Kuo, 8F, No. 39, Sau Nen Street, Hsinchu (TW)

( * ) Notice: Subject to any disclaimer, the term of this patent is extended or adjusted under 35 U.S.C. 154(b) by 0 days.

(21) Appl. No.: 09/524,606

(22) Filed: Mar. 14, 2000

(51) Int. Cl.[7] ..... A45B 25/14; A45B 25/16
(52) U.S. Cl. ..... 135/23; 135/29
(58) Field of Search ..... 135/23, 29, 31, 135/32, 38, 39, 40

(56) References Cited

U.S. PATENT DOCUMENTS 1,063,378 * 6/1913 Olsson ..... 135/23
5,390,686 * 2/1995 Lin et al. ..... 135/24
5,787,912 * 8/1998 Wu ..... 135/29

* cited by examiner

*Primary Examiner*—Michael Safavi
(74) *Attorney, Agent, or Firm*—Rosenberg, Klein & Lee

(57) ABSTRACT

A retracting mechanism used in an automatic multiple collapsible umbrella. The mechanism primarily consists of a spring, one end of which is attached to a second umbrella stretcher and the other end connected to a flexible rib and an umbrella strut. When the umbrella is collapsed, the restoring force of the spring will directly urge umbrella stretchers and ribs to move toward the central umbrella rod. The mechanism of the invention can produce an effect of smoothly collapsing umbrellas with less acting force. In addition, there is only one hole required for the attachment of the umbrella strut and flexible rib. Thus it also has the effects of enhanced strength and shortened manufacturing processes.

1 Claim, 3 Drawing Sheets

RETRACTING MECHANISM USED IN AN AUTOMATIC MULTIPLE COLLAPSIBLE UMBRELLA

BACKGROUND OF THE INVENTION

The collapsing mechanism of umbrellas according to a prior art typically has a spring (6), which is located between a second umbrella stretcher (2) and an umbrella strut (4). When the umbrella is collapsed, the retracting force of the spring (6) pulls back umbrella stretchers and ribs. A conventional mechanism is shown in FIG. 1, in which a spring (6) is attached at one end to the inner end of the second umbrella stretcher (2) and the other end connected to the outer end of an umbrella strut (4) at a point near the joint between a flexible rib (5) and the umbrella strut (4). When the umbrella is collapsed, the retracting force of the spring (6) urges the umbrella strut (4) and the flexible rib (5) to move upwardly. In this way the umbrella stretcher system gets into a collapsed state. Such a conventional design has a drawback that the retracting force of the spring produces a sideward component force, which retards the collapsing motion of stretchers. As a result, the conventional mechanism reveals a reluctant collapsing operation. Besides, the conventional mechanism needs two holes to be formed on the umbrella strut (4) for the attachment of the spring (6) and the flexible rib (5). Such an arrangement weakens the strength of umbrella struts (4) and makes them vulnerable to external forces.

In view of the above drawbacks, the primary object of the invention is to provide a retracting mechanism used in automatic multiple collapsible umbrellas, in which the outer end of a spring and the inner end of a flexible rib are attached to the same hole formed on an umbrella strut. The structure according to the invention can effectively solve the shortcoming of a conventional umbrella stretcher system and achieve an effect of smoothly collapsing umbrellas.

Now the structure and features of the invention will be described in detail with reference to the accompanying drawings.

BRIEF DESCRIPTION OF THE ACCOMPANYING DRAWINGS

DETAILED DESCRIPTION OF PREFERRED EMBODIMENTS

Figure 2:
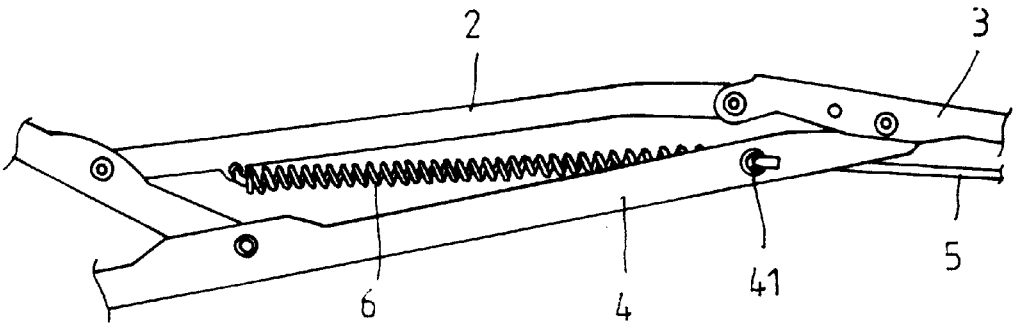
FIG. 2 is a plan view illustrating a locating spring according to the invention.
Figure 1:
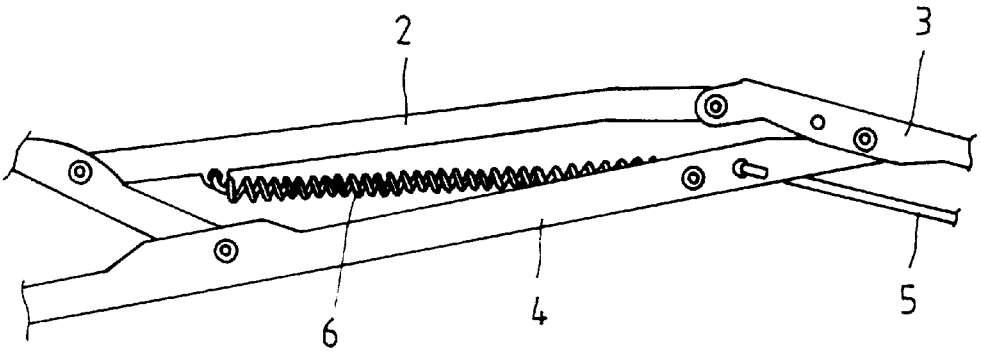
FIG. 1 (prior art)
FIG. 1 is a plan view showing a prior art locating spring.
Figure 3:
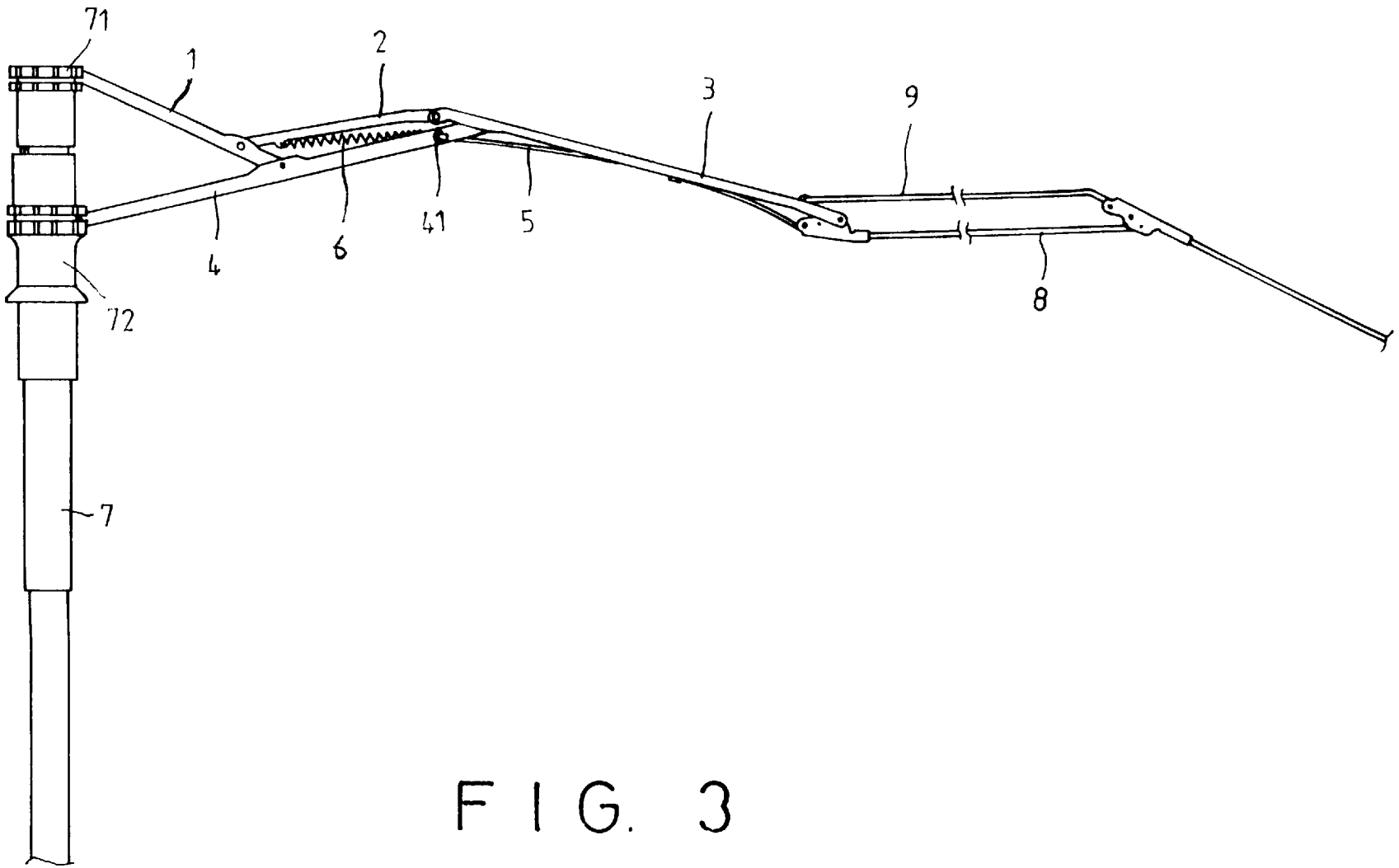
FIG. 3 is a plan view indicating an umbrella stretcher system using a locating spring of the invention, which umbrella stretcher system is in an open state.
Figure 4:
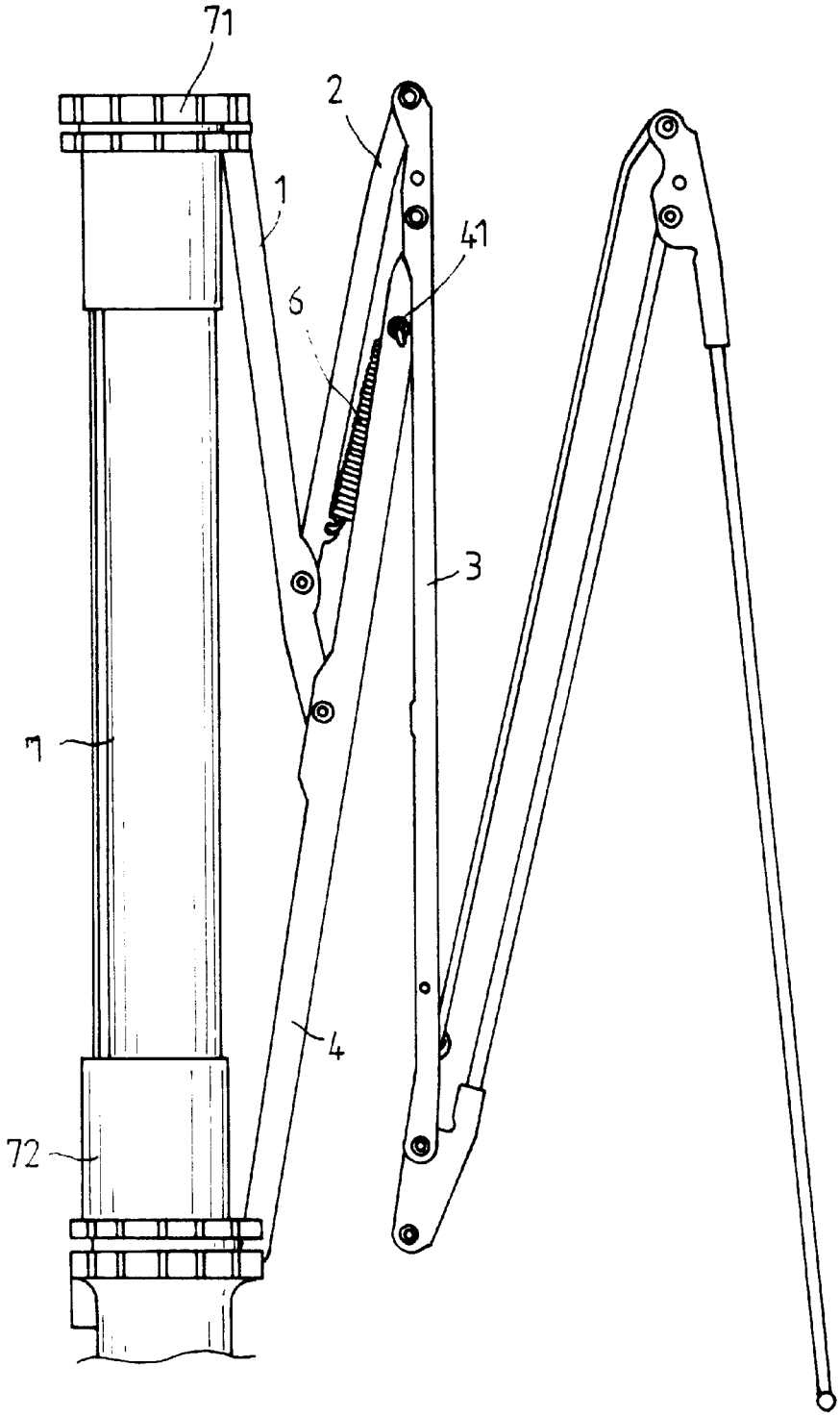
FIG. 4 is a plan view depicting the umbrella stretcher system of FIG. 3 in a collapsed state.

FIGS. 2 through 4 illustrate the improvements according to the invention made on a multiple collapsible umbrella stretcher system. Now the present invention will be described by means of an exemplary fourfold umbrella stretcher system. The umbrella stretcher system includes an umbrella rod (7), a cap (71) and a runner (72). A first umbrella stretcher (1) is pivotally connected at the inner end with the cap (71) and at the outer end with a second umbrella stretcher (2), a third umbrella stretcher (3) and umbrella ribs in sequence including intermediate rib 8 and rear rib 9. An umbrella strut (4) is connected at the inner end with the runner (72) and pivotally jointed at the outer end with the inner end of the third umbrella stretcher (3). Furthermore, the umbrella strut (4) is provided with a hole (41) near the pivotal joint. The hole provides the means attaching a flexible rib (5) to the umbrella strut (4).

The present invention is featured by a locating spring (6), of which the inner end is connected to the inner end of the second umbrella stretcher (2) and the outer end is attached to the hole (41) of the umbrella strut (4). That is to say, the outer end of the spring (6) and the inner end of the flexible rib (5) are joined with the strut (4) at the same location. Consequently, when the spring (6) restores to its original length after a forced extension, the retraction force will be automatically delivered to the flexible rib (5). Additionally, under the influence of a component force, the third umbrella stretcher (3) and the rear ribs rise for further collapsing the umbrella.

The mechanism according to the present invention has the advantage of directly delivering the restoring forces of the spring to the flexible rib (5) and thus it can easily perform a smooth collapsing operation of an umbrella without clinging phenomena, which is usually found in a prior art umbrella structure. Thus the invention can eminently enhance the performance of an automatic collapsible umbrella. In addition, with the arrangement according to the invention, there is only one hole formed in the umbrella strut (4) for both of the spring and the flexible rib. It also benefits the strength of an umbrella.

What is claimed is:

1. A multifold automatic umbrella with a retraction mechanism, the umbrella comprising:

an umbrella rod having a top end and a lower end, a cap positioned at said top end of said umbrella rod, a runner attached to said umbrella rod for sliding therealong between said cap and said lower end thereof, an umbrella strut having an inner end, an outer end and a hole formed at said outer end, said umbrella strut being attached by said inner end thereof to said runner, a first stretcher having an inner end and an outer end, said first stretcher being pivotally attached by said inner end thereof to said cap and by said outer end thereof to a middle portion of said umbrella strut between said inner and outer ends of said umbrella strut, a second stretcher pivotally attached by an inner end thereof to said first stretcher in proximity to said outer end thereof, an intermediate rib portion, a third stretcher pivotally coupled by an inner end thereof to an outer end of said second stretcher and by an outer end thereof to said intermediate rib portion, a flexible rod extending between said intermediate rib portion and said umbrella strut, said flexible rod being coupled by an inner end thereof to said outer end of said umbrella strut within said hole formed therein, and a spring having an inner end coupled to said inner end of said second stretcher, said spring having an outer end attached to said outer end of said umbrella strut within said hole formed thereat for direct engagement with said flexible rod.

* * * * *